United States Patent [19]

Calhoun et al.

[11] 4,151,962

[45] May 1, 1979

[54] APPARATUS FOR SHREDDING AND BLOWING FOAM PLASTIC IN PLACE

[76] Inventors: Thomas M. Calhoun, Rte. 2, Box 215; Guy L. Webb, Jr., Rte. 2, Box 197, both of El Dorado, Ark. 71730

[21] Appl. No.: 865,507

[22] Filed: Dec. 29, 1977

[51] Int. Cl.[2] ..... B02C 7/11

[52] U.S. Cl. ..... 241/101 A; 52/743; 144/176; 241/101.5; 241/278 R

[58] Field of Search ..... 241/101 A, 101.5, 278, 241/27; 52/404, 407, 743; 222/193; 302/2 A, 37, 44; 144/176, 167 R

[56] References Cited

U.S. PATENT DOCUMENTS

| | | | |
|---|---|---|---|
| 2,200,713 | 5/1940 | Ericson et al. | 241/101 A |
| 2,322,306 | 6/1943 | McLaren | 241/101 A |
| 2,550,354 | 4/1951 | Jacobsen | 241/101 A |
| 2,721,767 | 10/1955 | Kropp | 302/37 |
| 2,873,779 | 2/1959 | Eykamp | 241/101 A |
| 3,035,621 | 5/1962 | Burcham | 241/101 A |

*Primary Examiner*—Howard N. Goldberg
*Assistant Examiner*—Mark Rosenbaum
*Attorney, Agent, or Firm*—Clarence A. O'Brien; Harvey B. Jacobson

[57] ABSTRACT

A closed hollow housing including a first pair of opposite sides is provided and one of the sides includes an inlet opening formed therein for lengthwise receiving an elongated log of expanded foam plastic (Urea-formaldehyde) fed therethrough from the exterior of the housing. A driven rotor is journaled in the housing for rotation about an axis generally normal to the aforementioned side and with the rotor registered with the inner end of the opening. The rotor includes circumferentially and radially spaced elements supported therefrom and projecting outwardly from the axial end thereof opposing the aforementioned one side of the housing for engaging and shredding the end of the expanded foam plastic log being advanced into the housing through the opening. A particulate conveying blower including an inlet and an outlet has its inlet opening into the interior of the housing through the aforementioned one wall in registry with the rotor periphery at a location spaced angularly about the axis of rotation of the rotor from the housing opening and a flexible hose having large and small diameter inlet and outlet end portions has its inlet end portion coupled to the outlet of the blower, whereby expanded foam plastic particulate vacuumed from the housing may be propelled through the hose and spray discharged from the outlet end thereof into the spaces between ceiling joists.

10 Claims, 9 Drawing Figures

APPARATUS FOR SHREDDING AND BLOWING FOAM PLASTIC IN PLACE

BACKGROUND OF THE INVENTION

Various procedures are followed in spray discharging particulate insulation material between ceiling joists. Many of these procedures involve the loading of insulating material into a hopper and controllably discharging the particulate material from the hopper into the inlet of a blower assembly having a discharge hose coupled to the outlet thereof. However, these procedures involve transporting bagged particulate insulated material to a job site, emptying the bags of particulate into a hopper provided therefor, controllably discharging the particulate material from the hopper into a blower-type conveyor assembly including a discharge hose and thereafter spray discharging the particulate insulated material at the location of use. In addition, other insulating procedures include carrying particulate insulated material to the point of use in bags and dumping the material directly from the bags into the spaces between ceiling joists. The method of using a hopper for particulate insulated material from which the particulate material is controllably discharged into a blower-type conveyor system requires excessive storage capacity in vehicles transporting the particulate insulated material to the job site, an unnecessarily large labor force to open the bags of particulate, dump the bags of particulate into a hopper, control the discharge of particulate into the blower-type conveyor assembly and to control the discharge end of the hose of the conveyor assembly for discharging the particulate between ceiling rafters. Also, the procedure of carrying bagged particulate insulated material to the point of use requires the transport of large cumbersome bags of particulate material through residences and other buildings to the point of use and excessive time to empty the contents of each bag into proper position.

Accordingly, a need exists for a means whereby premolded logs of relatively compact expanded foam plastic insulated material may be shredded on the job site and conveyed to the point of use through a conveniently handled discharge hose through which the shredded particulate insulated material may be conveyed.

While various forms of material shredders have been heretofore designed, most of these material shredders are not operative to properly shred expanded foam plastic logs into proper particulate size and to convey the shredded particulate insulated material to the point of use.

Various forms of shredders including some of the general structural and operational features of the instant invention are disclosed in U.S. Pat. Nos. 2,322,306, 2,422,094, 2,962,234, 3,035,621, 3,410,495, and 3,697,004.

BRIEF DESCRIPTION OF THE INVENTION

The instant invention resides in a method and apparatus for shredding expanded foam plastic logs into particulate insulated material and conveying the particulate insulated material to the point of use in a single operation through a discharge hose of the apparatus.

Structure is provided whereby logs of expanded foam plastic may be shredded and the shredded particulate may be vacuumed from the housing of the shredder and discharged into a conveyance hose for discharging at the point of use. The blower portion of the apparatus is operatively associated with the shredded portion of the apparatus in a manner such that the feed of logs of expanded foam plastic into the shredder is automatically accomplished and the apparatus is relatively small in comparison to other shredder devices and, therefore, occupies only a small area of a transport truck which may also be used to transport precast logs of expanded foam plastic to the job site. By shredding the expanded foam plastic at the job site, the foam plastic may be transported to the job site in compact log form and greater amounts of expanded foam plastic may therefore be transported in a transport vehicle of a given size. In addition, the apparatus of the instant invention is so small in comparison to other shredding devices that it may remain on the transport vehicle and, therefore, enable logs from the transport vehicle to be fed into the shredder portion of the apparatus without removing the expanded foam plastic logs from the transport vehicle. Accordingly, by utilizing the apparatus of the instant invention, only two workmen are required.

The main object of this invention is to provide a method and apparatus for shredding expanded foam plastic logs and conveying the shredded foam plastic particulate to a point of use with a minimum amount of labor and in a manner enabling large quantities of foam plastic to be shredded and conveyed in a short period of time.

Another object of this invention is to provide a method of on-the-site shredding of expanded foam plastic and conveying the shredded foam plastic to a point of use so as to thereby enable persons insulating residences and other buildings to transport the insulating material to the job site in a compact form and to shred the insulating material on the vehicle utilized to convey the insulated material to the job site and thus eliminate the necessity of even having to unload the insulated material from the vehicle.

Yet another object of this invention is to provide a method and apparatus in accordance with the preceding objects and which will enable logs of expanded foam plastic having a cross-sectional area of approximately one square foot to be shredded and conveyed to the point of use at the rate of approximately three log feet of expanded foam plastic a second.

A further object of this invention is to provide a method and apparatus for accomplishing home and other building insulation which requires a minimum amount of mechanical structure and represents a considerable savings in man hours.

A final object of this invention to be specifically enumerated herein is to provide a method and apparatus in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the etails of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
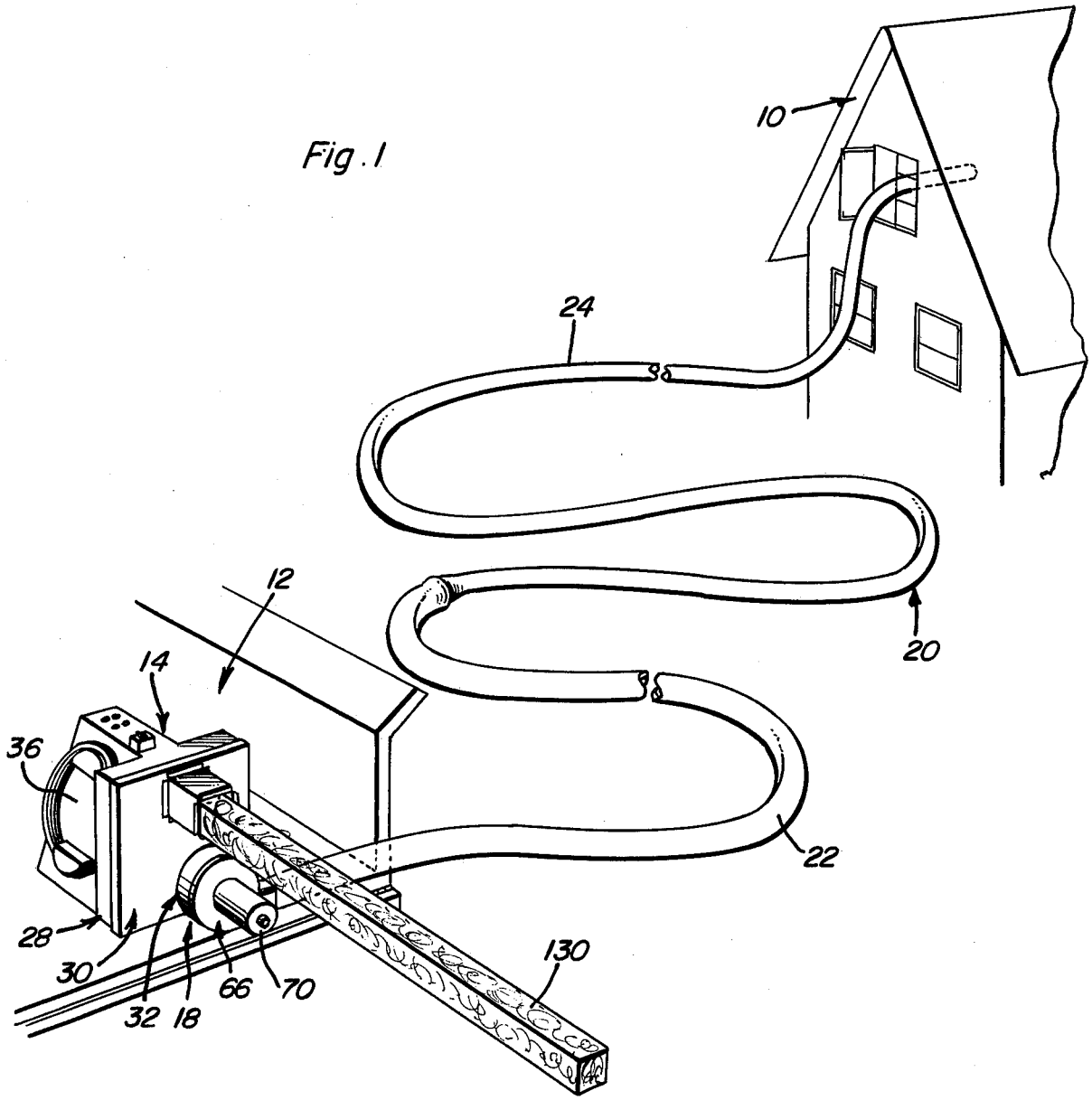
FIG. 1 is a perspective view of the apparatus of the instant invention in operation shredding logs of expanded foam plastic on a vehicle and conveying the shredded particulate foam plastic to a point of use.
Figure 8:
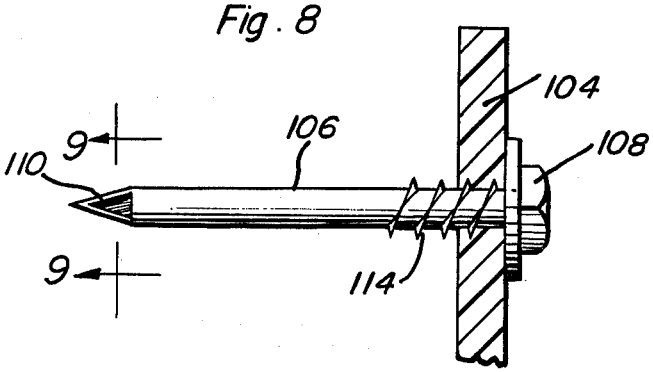
FIG. 8 is an enlarged fragmentary, vertical sectional view taken substantially upon the plane indicated by the section line 8—8 of FIG. 6.
Figure 9:
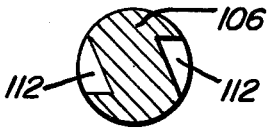
FIG. 9 is an enlarged fragmentary, vertical sectional view taken substantially upon the plane indicated by the section line 9—9 of FIG. 8.
Figure 2:
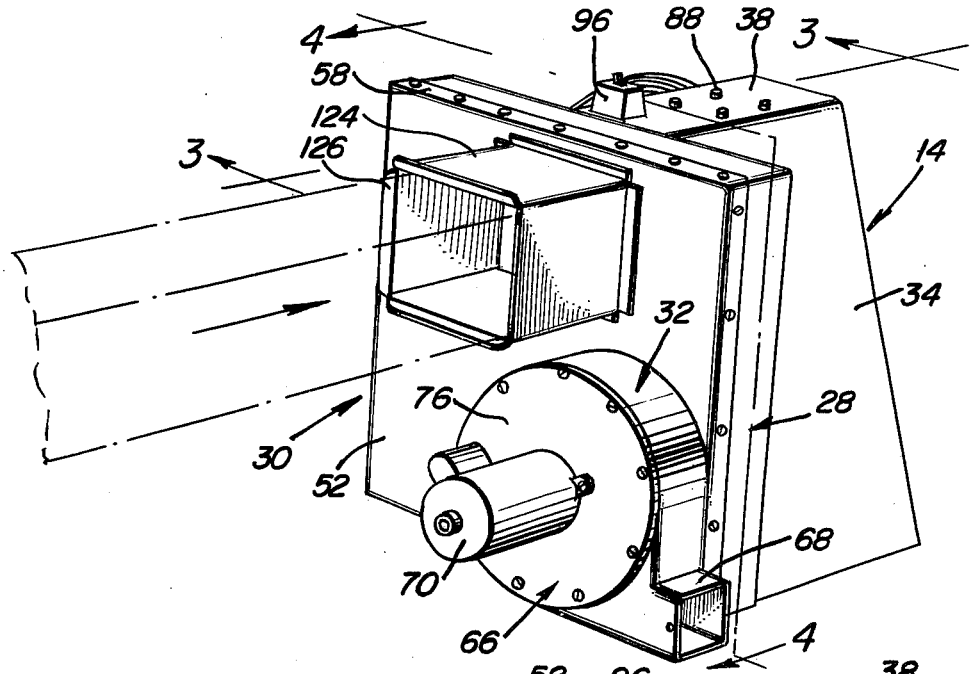
FIG. 2 is a perspective view of the shredder and blower assemblies of the apparatus.
Figure 3:
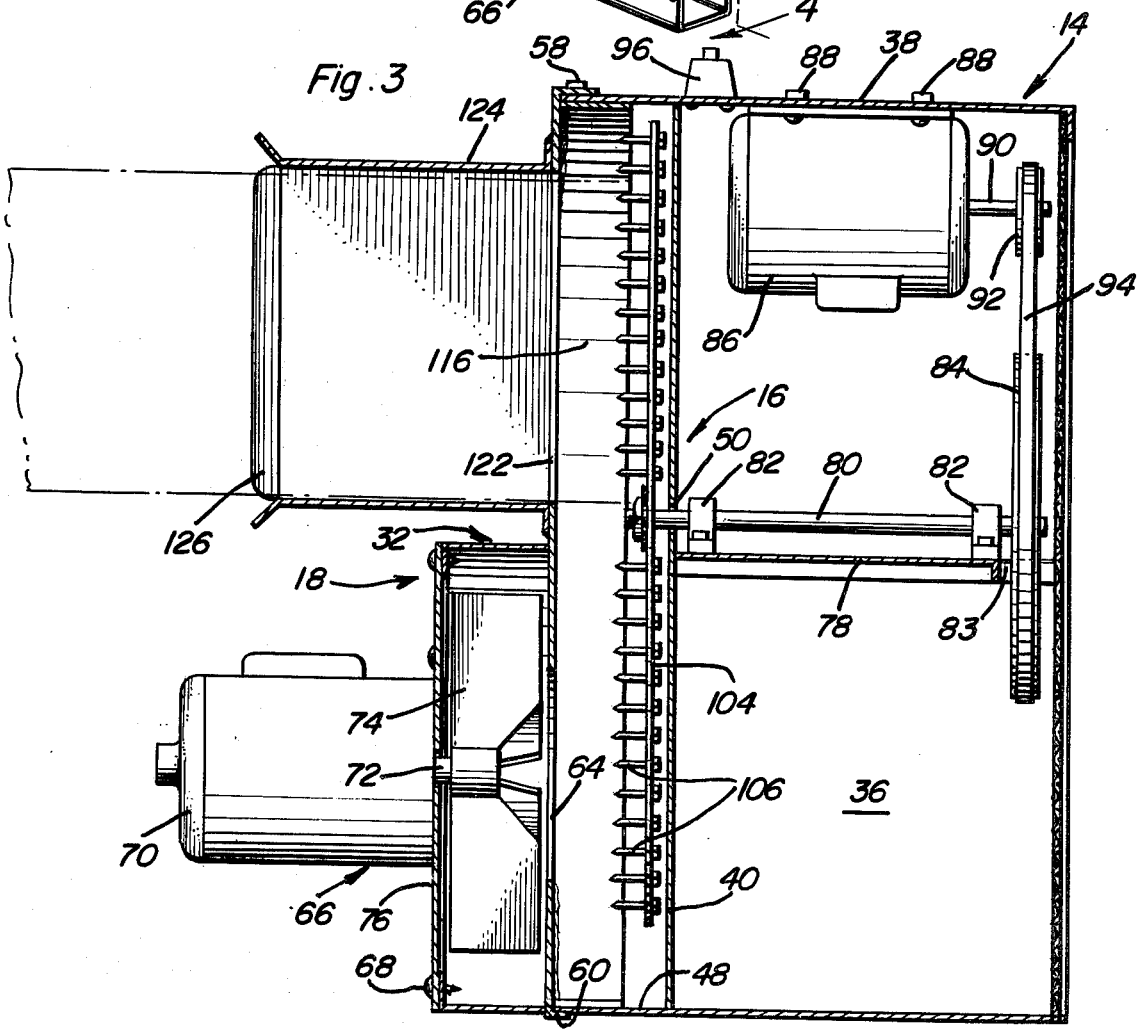
FIG. 3 is an enlarged fragmentary, vertical sectional view taken substantially upon the plane indicated by the section line 3—3 of FIG. 2.
Figure 4:
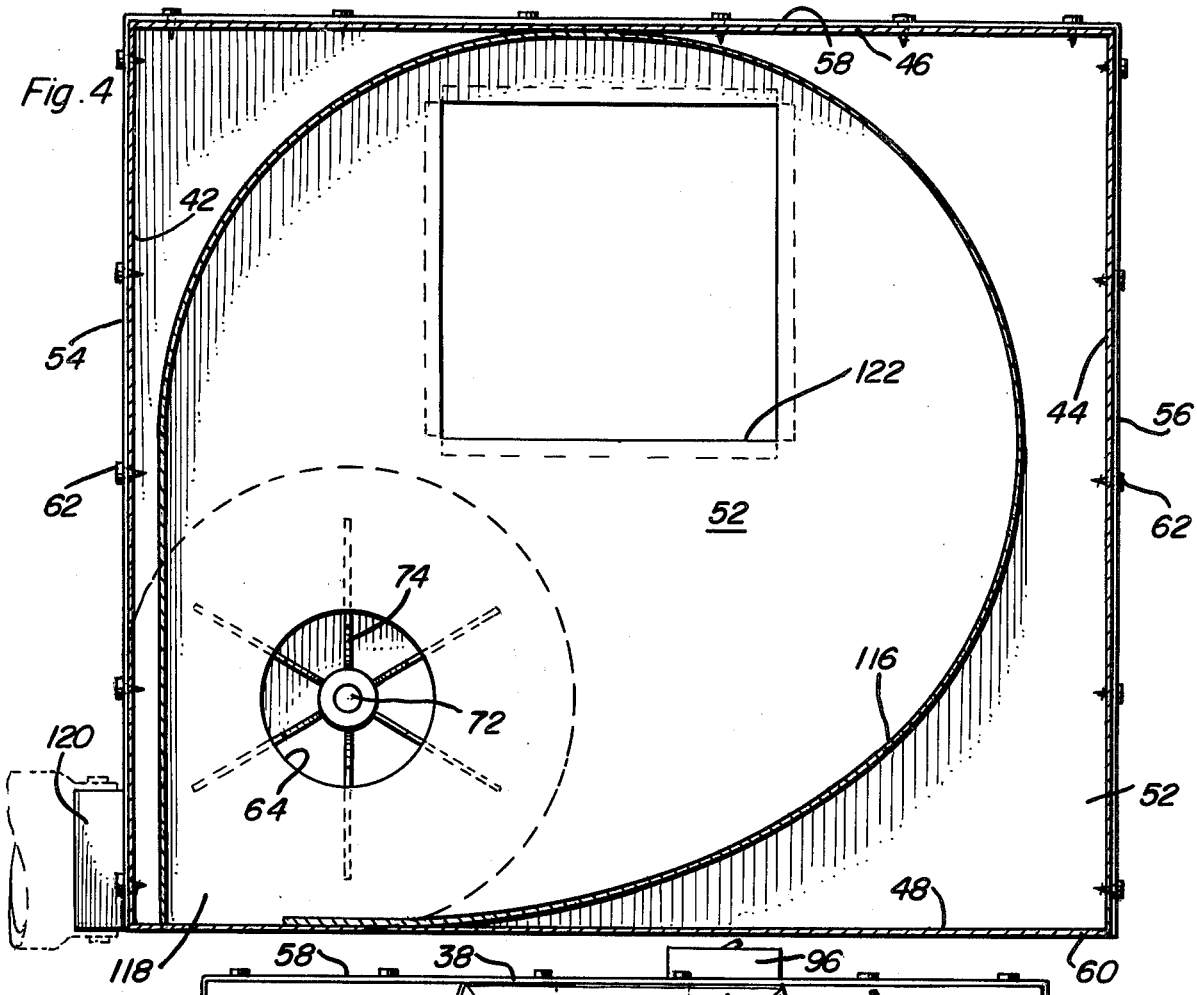
FIG. 4 is an enlarged fragmentary, vertical sectional view taken substantially upon the plane indicated by the section line 4—4 of FIG. 2.
Figure 7:
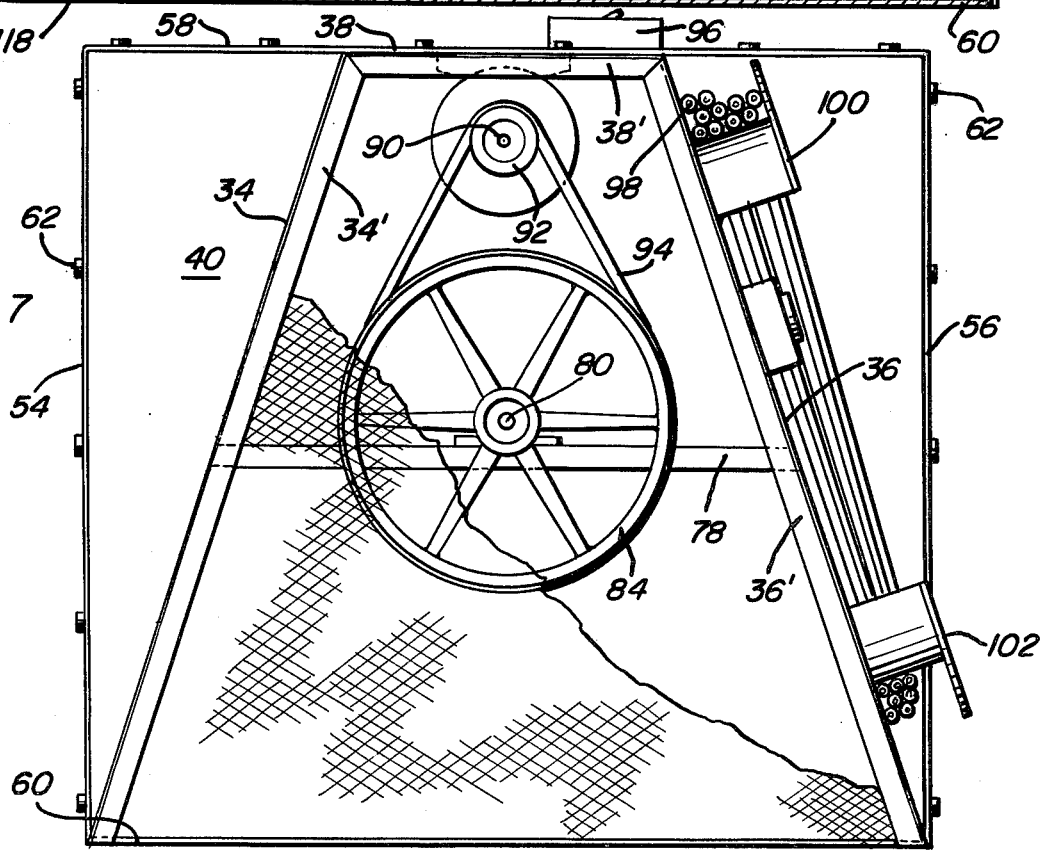
FIG. 7 is a rear elevational view of the assemblage illustrated in FIG. 2 and on somewhat of an enlarged scale.

Referring now more specifically to the drawings, the numeral 10 generally designates a residence into whose attic it is desired to discharge particulate insulated material between the ceiling joists. The apparatus of the instant invention is referred to in general by the reference numeral 12 and includes a housing referred to in general by the reference numeral 14 which is composed of a shredder assembly referred to in general by the reference numeral 16 and a blower assembly referred to in general by the reference numeral 18. In addition, the apparatus 12 includes an elongated flexible hose assembly referred to in general by the reference numeral 20 including an inlet end portion 22 and an outlet end portion 24. The hose assembly 20 is utilized to convey shredded particulate foam plastic from the housing 14 into the attic of the residence 10.

Referring now more specifically to FIGS. 2 through 6 of the drawings it may be seen that the housing includes a trapezoidal-shaped rear section referred to in general by the reference numeral 26, a generally square center section referred to in general by the reference numeral 28 and a front cover section referred to in general by the reference 30 as well as an axial inlet and tangential outlet blower housing section referred to in general by the reference numeral 32.

The trapezoidal rear section 26 includes downwardly divergent opposite side walls 34 and 36 interconnected at their upper ends by means of a horizontal top wall 38 extending therebetween. The rear marginal edges of the walls 34, 36 and 38 include inturned flanges 34', 36' and 38'. The center section 28 includes a substantially square rear wall 40 and integral forwardly directed opposite side flanges 42 and 44 and integral forwardly directed top and bottom flanges 46 and 48 extending between the upper and lower ends of the flanges 42 and 44. The central portion of the rear wall 40 has an opening 50 formed therethrough and the forward marginal edges of the opposite side walls 34 and 36 and the top wall 38 are secured to the rear of the rear wall 40 in any convenient manner.

The front cover section 30 includes a front wall 52 provided with rearwardly directed opposite side flanges 54 and 56 and rearwardly directed top and bottom flanges 58 and 60. The front cover section 30 is secured over the front of the center section 28 with the flanges 54, 56, 58 and 60 lapped over and secured to the flanges 42, 44, 46 and 48 by means of sheet metal fasteners 62.

The front wall 52 of the cover section 30 further includes a circular opening 64 in one lower corner portion thereof and the blower housing section 32 is secured to the front surface of the front wall 52 in coaxial relation with the opening 64. The blower assembly 18 includes a blower housing structure 32 and also a motor and impeller assembly referred to in general by the reference numeral 66 which is secured over the open front side of the blower housing section 32 by means of suitable fasteners 68. The motor and impeller assembly 66 includes a one and one-half horse power 3450 RPM motor 70 including a rotary output shaft 72 upon which a 12½ inch outside diameter six bladed impeller 74 is mounted and the motor and impeller assembly 66 further includes a circular mounting plate 76 supported from the motor 70, through which the shaft 72 projects and which is secured over the open front side of the blower housing section 32 by means of the fasteners 68.

The shredder assembly 16 includes a horizontal brace structure 78 extending and secured between the vertical midportions of the opposite side walls 34 and 36 and from which a shaft 80 is journaled through the utilization of pillow block bearings 82 supported from the brace structure 78. The shaft 80 extends in a front-to-rear horizontal direction relative to the housing 14 with its forward end projecting through the opening 50 and its rear end received in a rearwardly opening notch 83 in the brace structure 78 and having a 12 inch diameter pulley 84 mounted thereon. A ¾ horse 1725 RPM power electric motor 86 is suspended beneath the top wall 38 by means of fasteners 88 and includes a rotary output shaft 90 upon which a three inch diameter pulley 92 is mounted in alignment with the pulley 84 and flexible belt 94 is trained about the pulleys 92 and 84 and thereby drivingly connects the shaft 90 to the shaft 80. A switch 96 is supported from the top wall 38 and, when closed, electrically connects one end of an extension cord 98 to the motors 70 and 86. The outer side of the side wall 36 includes upper and lower support brackets 100 and 102 about which the extension cord 98 may be coiled for storage purposes and the other end of the extension cord 98 may, of course, be electrically connected to a suitable source of electrical potential (not shown).

The shredder assembly 16 further includes a circular disk-shaped rotor 104 threadingly mounted on the forward end of the shaft 80 for adjustable positioning therealong toward and away from the front wall 52 and forwardly of the rear wall 40 and the rotor 104 includes a plurality of headed studs 106 threadedly engaged therewith including flanged heads 108 at one end and conical tips 110 at the other end. The tips 110 include axially extending diametrically opposite grooves 112. The headed studs 106 may be secured through and threadedly engaged with the disk or rotor 104 by turning the conical tips 110 of the studs 106 against the rear side of the disk or rotor 104 and after the tips 110 have penetrated the disk or rotor 104, the threaded portions 114 of the studs 106 are turned into tight threaded engagement with the disk or rotor 104.

The studs 106 are approximately 1⅛ inches long and the disk or rotor 104 is constructed of 3/16 inch plate material. The disk 104 is circular and the inner side of the front wall 52 has an arcuate band 116 secured thereto defining a generally cylindrical cavity in which to closely receive the disk 104, but which includes a corner portion 118 at the lower right hand portion of the front wall 52 as viewed from the front side thereof. The opening 64 opens into the corner portion 118 and the blower housing structure 32 includes a tangential outlet neck 120 which projects horizontally outwardly from the lower portion of the right hand side of the housing 14 as viewed from the front thereof.

The upper central portion of the front wall 52 further has a square opening 122 formed therein and the opening 122 is approximately one foot square. The outer side of the front wall 52 includes a tubular guide 124 supported therefrom in alignment with the opening 122 and the guide 124 projects forwardly of the front wall 52 and is flared at its forward end as at 126. The lower marginal portion of the opening 122 is substantially horizontally aligned with the axis of rotation of the shaft 80 and the transverse center of the opening 122 lies on a vertical plane containing the axis of rotation of the shaft 80. Further, the disk 104 rotates in a clockwise direction as viewed from the front of the housing 14.

Figure 6:
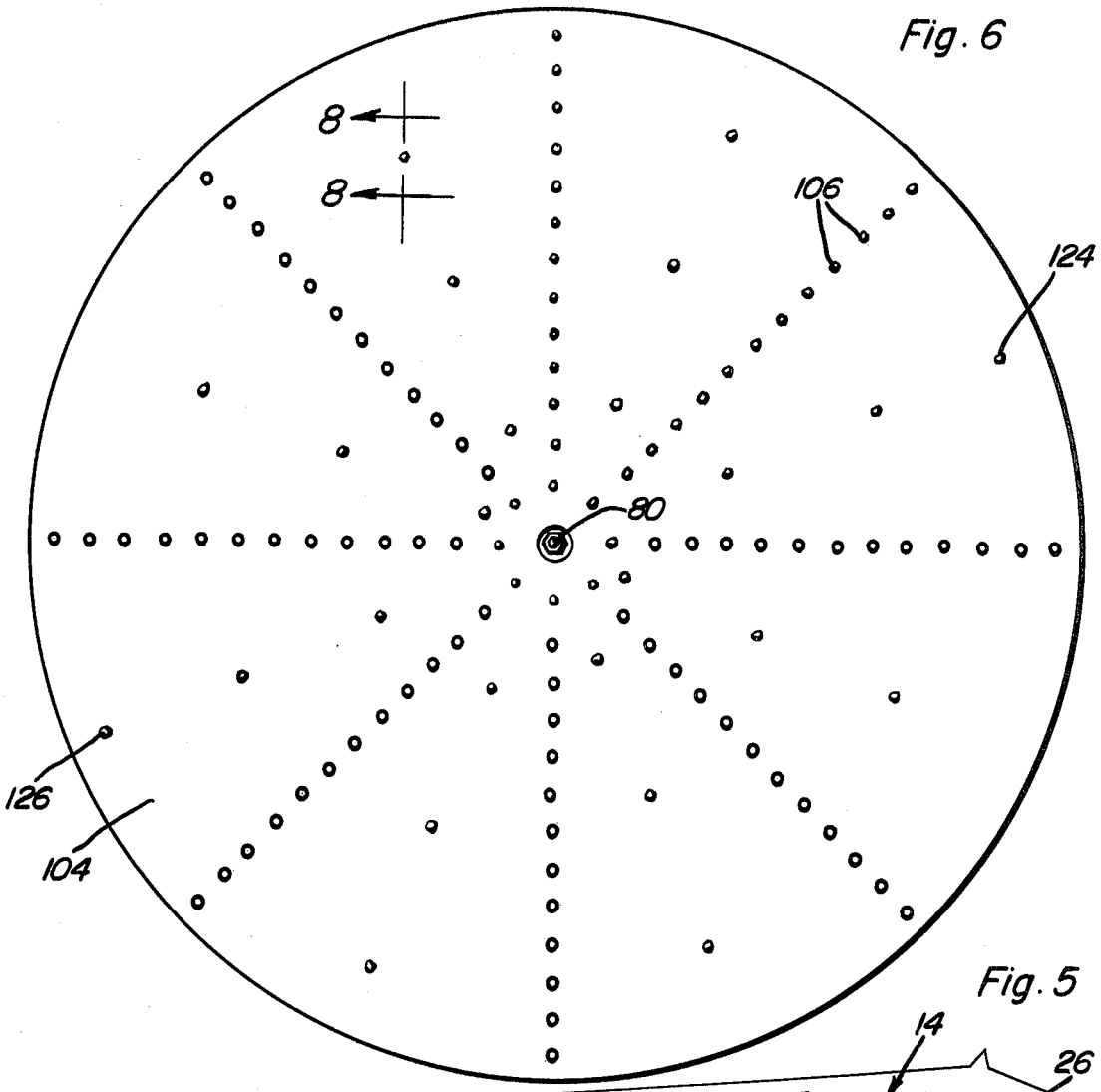
FIG. 6 is a face elevational view of the rotor portion of the shredder apparatus.
Figure 5:
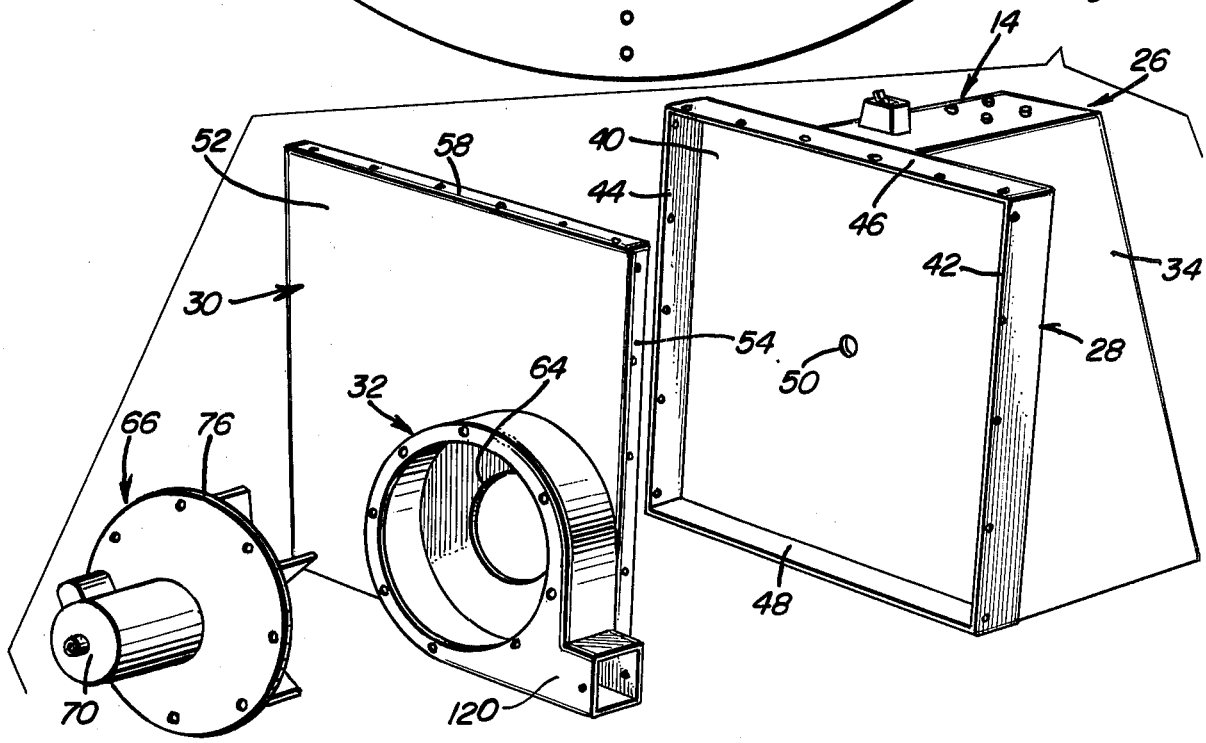
FIG. 5 is an exploded perspective view of the housing of the shredder and blower structures with the blower assembly detached from the front wall of the housing.

With attention now invited more specifically to FIG. 6 of the drawings, it may be seen that the studs 106 are arranged in a pattern including eight equally angularly displaced radial zones of the disk 104. The studs 106 in each radial zone are spaced one inch apart and corresponding studs of the radial zones of studs are spaced equally from the axis of rotation of the shaft 80. Further, the studs are also arranged in 180 degree relatively angularly displaced inwardly spiralling paths beginning at their outer ends at 124 and 126 with the studs 106 of each inwardly spiralling path being disposed in radial zones spaced centrally intermediate the radial zones in which the other studs 106 are disposed, the studs of the inwardly spiralling paths scribing arcs spaced centrally between the arcs scribed by the studs 106 disposed in radial zones of the plate or disk 104.

In operation, an 8 foot long log 130 of expanded foam plastic is fed into the housing 14 through the guide 124 and the opening 122 and is engaged by the studs 106 during rotation of the disk 104 and the expanded foam plastic material of the log 130 is shredded from the inner end thereof. Inasmuch as the blower assembly 18 is in operation whenever the motor 86 is in operation, the shredded particulate expanded foam plastic is vacuumed from within corner portion 118, the cavity defined by the band 116 through the opening 64 in the front wall 52 and into the blower housing section 32 for discharge therefrom under pressure through the outlet neck 120. The large diameter end portion 22 of the hose assembly 20 is coupled to the outlet neck 120 and thus the shredded particulate expanded foam plastic is blown through the hose assembly 20 into the small diameter end portion 24 thereof and into the attic of the residence 10.

The blower assembly 18 is capable of pulling approximately eight inches (water column) of vacuum when the inlet thereof is closed and maintains approximately four inches (water column) of vacuum within the housing 14 when in operation and when a log 130 is being fed into the housing 14 through the guide 124 and the opening 122. Inasmuch as the opening 122 is approximately one inch higher and one inch wider than the height and width of the log 130, air is drawn into the housing by the blower assembly 18 between the exterior surfaces of the logs 130 and the opposing edges of the opening 122. This air moves pass the logs 130 at sufficient velocity whereby friction of the air passing along the logs 130 tends to feed logs 130 into the housing 14. In addition, inasmuch as the inner end of the log 130 is subject to four inches (water column) of vacuum as opposed to atmospheric pressure, the higher air pressure at the outer end of the log 130 also tends to feed the log 130 into the housing 14 through the opening 122. Accordingly, the apparatus 12 is self-feeding insofar as the feeding of the logs 130 thereinto is concerned, as long as the outer end portions of the logs 130 projecting outwardly of the guide 126 are supported in a manner whereby frictional resistance to longitudinal shifting of the logs 130 is maintained at a minimum. Any suitable anti-friction support structure (not shown) may be provided for the logs 130 outwardly of the housing 14.

The motor 86 drives the disk 104 in a clockwise direction as viewed from the front of the housing and, accordingly, as soon as the expanded foam plastic is shredded from the inner end of the log it is directed downwardly toward the opening 64 for the blower assembly 18 and the particulate expanded foam plastic may be quickly drawn from within the chamber defined by the band 116 and into the blower housing section 32 for discharging therefrom through the outlet neck 120. By initially passing the discharged air and particulate expanded foam plastic material from the discharge neck 120 into the large diameter end portion 22 of the hose assembly 20, the particulate material is maintained in suspension within the flow of air through the large diameter end portion 22. By thereafter passing the air and particulate expanded foam plastic material through the small diameter end portion 24 of the hose assembly 20, the particulate and air are accelerated and discharged from the discharge end of the hose assembly 20 in a manner enabling the particulate material to be more conveniently and effectively blown into the spaces between ceiling joists. If the large diameter of the end portion 22 was used throughout the hose assembly 20, the particulate material would tend to be discharged from only the lower portion of the hose assembly 20 and if the smaller diameter end portion 24 was used throughout the length of the hose assembly 20, there would be a tendency for the particulate material to clog within the hose assembly 20 and to thus require shutting down the apparatus 12, empting the hose assembly 20 and then restarting the apparatus 12.

A workman positioned at the vehicle upon which the apparatus 12 rests may readily remove logs 130 from their resting position witin the vehicle and feed the logs 130 into the apparatus 12. The apparatus is capable of shredding the logs 130 at the rate of approximately three log feet per second. Accordingly, it may be seen that the expanded foam plastic logs 130 may be rapidly shredded and conveyed, in shredded form, into the residence 10 for blowing into the spaces between ceiling joists.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A foam plastic shredder including a closed hollow housing including a first pair of opposite sides, one of said sides including an inlet opening formed therein adapted to have the elongated log of expanded foam plastic fed therethrough from the exterior of said housing into the interior therof, a driven rotor disk journaled in said housing for rotation about an axis generally normal to said one side and disposed at least substantially entirely to one side of said opening, said rotor including circumferentially and radially spaced elements supported therefrom and projecting outwardly from the axial end of said rotor opposing the inner surface of said one housing side for swinging past said inlet opening and engaging and shredding the end of said log being advanced into said housing through said opening, a particulate conveying blower including axial inlet and tangential outlet means, said inlet means opening into said housing through said one side of said housing in at least substantial full registry with said rotor at a location spaced angularly about said axis from said opening and radially outwardly of said axis.

2. The combination of claim 1 wherein said rotor rotates in a first direction and said location is angularly displaced about said axis in said first direction less than 180 degrees from said opening.

3. The combination of claim 2 wherein said housing includes means defining a generally cylindrical cavity closed at one end by said one side of said housing and in which said rotor is substantially coaxially journaled.

4. The combination of claim 3 wherein said cavity includes one corner portion defined by generally right angular sides of said cavity extending away from said one corner portion and substantially tangent to 90 degree relatively angularly displaced portions of said cylindrical cavity.

5. The combination of claim 1 wherein said axis is generally horizontally disposed and said opening is spaced at least substantially entirely above said axis.

6. The combination of claim 5 wherein said rotor rotates in a first direction and said location is angularly displaced about said axis in said first direction less than 180 degrees from said opening.

7. The combination of claim 6 wherein said housing includes means defining a generally cylindrical cavity closed at one end by said one housing end wall and in which said rotor is substantially coaxially journaled.

8. The combination of claim 1 including a flexible discharge hose for conveying air entrained shredded expanded foam plastic from said outlet means to a remote location, said discharge hose including inlet and outlet end portions, said inlet end portion being operatively coupled to said outlet means for receiving air entrained expanded foam plastic from said outlet means and being of a cross-sectional area generally equal to the cross-sectional area of said outlet means.

9. The combination of claim 1 wherein said blower means includes an axial inlet and tangential discharge rotary blower whose inlet opens directly through said one housing wall into the interior of said housing.

10. The combination of claim 1 wherein said opening in said one wall of said housing is of a predetermined cross-sectional size and shape and is adapted to slidingly closely receive a log of comparable cross-sectional shape and slightly smaller transverse dimensions therethrough with the spacing between said log and the opposing surfaces of said housing defining said opening being appreciably restrictive relative to the flow rate of said blower, whereby the air pressure within said housing will be maintained appreciably sub-ambient when a log is projecting through said opening and the pressure differential between the opposite ends of said log as well as the friction of air passing through said opening along a plurality of sides of said log will effect a net inward thrust on said log for self feeding of said log inwardly of said opening and toward engagement with said elements.

* * * * *